US007156541B2

(12) United States Patent
Yeung

(10) Patent No.: US 7,156,541 B2
(45) Date of Patent: Jan. 2, 2007

(54) PROJECTOR DESK LAMP

(75) Inventor: Yiu Shun Ringo Yeung, Hong Kong (CN)

(73) Assignee: Wai Kwong Industrial Products Limited, Hong Kong (CN)

( * ) Notice: Subject to any disclaimer, the term of this patent is extended or adjusted under 35 U.S.C. 154(b) by 123 days.

(21) Appl. No.: 10/891,716

(22) Filed: Jul. 14, 2004

(65) Prior Publication Data

US 2006/0013008 A1 Jan. 19, 2006

(51) Int. Cl.
*F21V 19/02* (2006.01)

(52) U.S. Cl. ..... 362/418; 362/419; 362/427; 362/428; 362/430

(58) Field of Classification Search ..... 362/428, 362/418, 419, 427, 430
See application file for complete search history.

(56) References Cited

U.S. PATENT DOCUMENTS 2,341,223 A * 2/1944 Lillie ..... 353/62
2,474,484 A * 6/1949 Marchese ..... 362/395
4,494,177 A * 1/1985 Matthews ..... 362/402
5,868,487 A * 2/1999 Polley et al. ..... 362/33
6,206,524 B1 * 3/2001 Jacob ..... 353/43
6,350,042 B1 * 2/2002 Lai ..... 362/277

* cited by examiner

*Primary Examiner*—Stephen F Husar
*Assistant Examiner*—Meghan K. Dunwiddie
(74) *Attorney, Agent, or Firm*—Alix, Yale & Ristas, LLP

(57) ABSTRACT

A projector desk lamp employs a base for supporting components of said desk lamp on a flat surface. A stem with one end forming an adjustable articulated joint with said base that can be swung between a horizontal position and a vertical position freely and can be locked in intermediate positions. A lock knob mechanism is used for quickly releasing and locking said stem during adjustment. A bracket is formed on the other end of said stem. A lamp head which is adjustably articulately joined by said bracket can be swung in more than 180 degrees and can be locked in intermediate positions. A lamp head comprises a bulb, a reflector, an adjustable lens assembly and a disc-shaped slide. Therefore, this lamp can be used as a projector for enlarging images of the slide projected on any surface with a selectively adjustable ratio. It can also be used as a desk lamp to illuminate an area with adjustable beam-angle and brightness.

20 Claims, 5 Drawing Sheets

PROJECTOR DESK LAMP

FIELD OF THE INVENTION

This invention relates to lighting devices, particularly to a desk lamp which can be used as a projector for helping the designer/student to write words or to draw figures with the projected image.

BACKGROUND OF THE INVENTION

Desk lamps are widely used by designers and students. Since a desk lamp is used to write words or to draw figures, the illuminating area is typically not large. The area illuminated by a desk lamp should be brighter than any area illuminated by a table lamp. Therefore, all prior art desk lamps have a reflector for converging projected light beams (from the bulb) into a relatively small area, and some desk lamps even have a lens for converging said convened light beams into an even smaller area. All prior desk lamps have typically been designed to illuminate the working area on the desk, but the main function of a desk lamp should be to help the user to write words or draw figures, and not only limited to providing illumination. Applicant has found no prior art desk lamp which has the function of helping the user to write words or to draw figures. For example, a student or designer always has a need to enlarge existing words or figures on a paper. If the words or figures can be projected (enlarged) onto the paper by the desk lamp with a predetermined ratio, he (or she) can easily outline the words or figures on the paper.

The principal optical components such as the light source (the bulb), the reflector and the lens may already exist in a conventional desk lamp. The additional projection function can be achieved with suitable modifications of the desk lamp. In addition, existing mechanical structure for a traditional desk lamp such as the base, the stem, the bracket, etc., can also fulfill the newly added optical function; no additional supporting structure should be added for this newly added optical function.

SUMMARY OF THE INVENTION

An object of this invention is to provide a desk lamp which not only carries out the traditional illuminating function but also projects intended images of words or figures onto any surface (such as on a desk or on a wall) with a selected ratio for the user to easily outline the projected (enlarged) images.

For achieving the above mentioned object, the projector desk lamp in one embodiment of this invention comprises:

a base for supporting components of the desk lamp on a flat surface;

a stem with one end connected in an adjustable articulate joint with said base and that can be freely swung between a horizontal position and a vertical position and can be locked in any position in between;

a lock knob mechanism used for quickly releasing and locking the stem during adjustment;

a bracket formed on the other end of said stem;

a lamp head adjustably articulately joined by said bracket that can be swung in more than 180 degrees and can be locked in any position; and said lamp head comprising a bulb, a reflector, a disc-shaped slide, an adjustable lens assembly comprising a set of convex lens and concave lens and a focus ring.

BRIEF DESCRIPTION OF THE INVENTION

DETAILED DESCRIPTION OF THE PREFERRED EMBODIMENTS

Figure 1A:
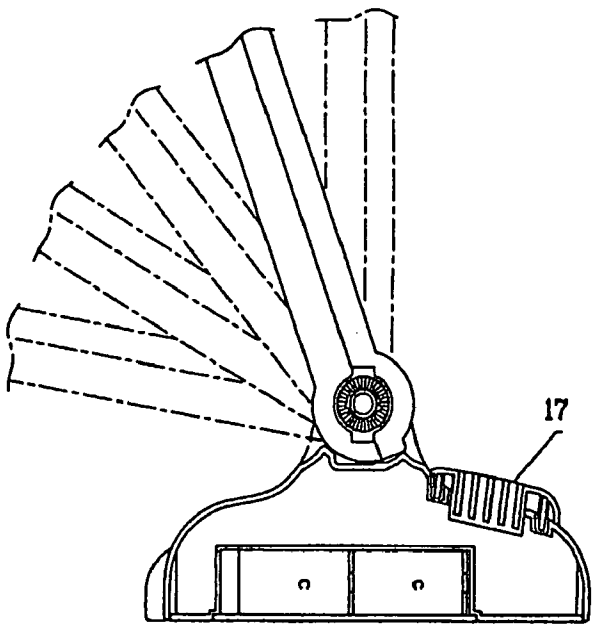
FIG. 1A is an enlarged fragmentary side view, partly in schematic and partly in section, of a base portion of the projector desk lamp of FIG. 1.
Figure 1:
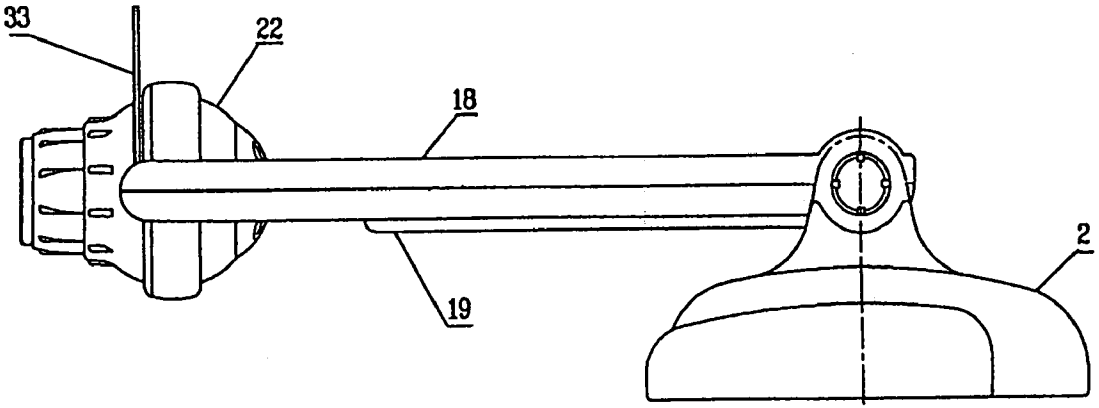
FIG. 1 is a side view of the projector desk lamp of this invention.

As illustrated in FIG. 1, the projector desk lamp in one embodiment of this invention basically comprises a base 2, a stem 18, 19 and a head 22. The base 2 is used to house batteries, to mount a switch and to support the stem 18, 19 and the head 22. In this embodiment, the base 2, stem 18, 19 and head 22 are all made of plastics. In practice, the material is not limited to plastics; any suitable material can be used for manufacturing the base 2, stem 18, 19 and head 22. In this embodiment, batteries will be inserted in the base 2 to provide an energy source and ballast weight; if necessary, additional ballast weight can be added.

FIG. 1 shows that the stem 18, 19 on base 2 is swung to its lowest position and a piece of a slide (film) 33 in the form of a disc is installed on the head 22. FIG. 1A shows that the stem 18, 19 can be swung at any position within 90 degrees as viewed from the side. FIG. 2A shows a detailed section of the head 22 for showing both optical and mechanical constructions of the head 22. The base has a holder 17 for slides (films).

Figure 2:
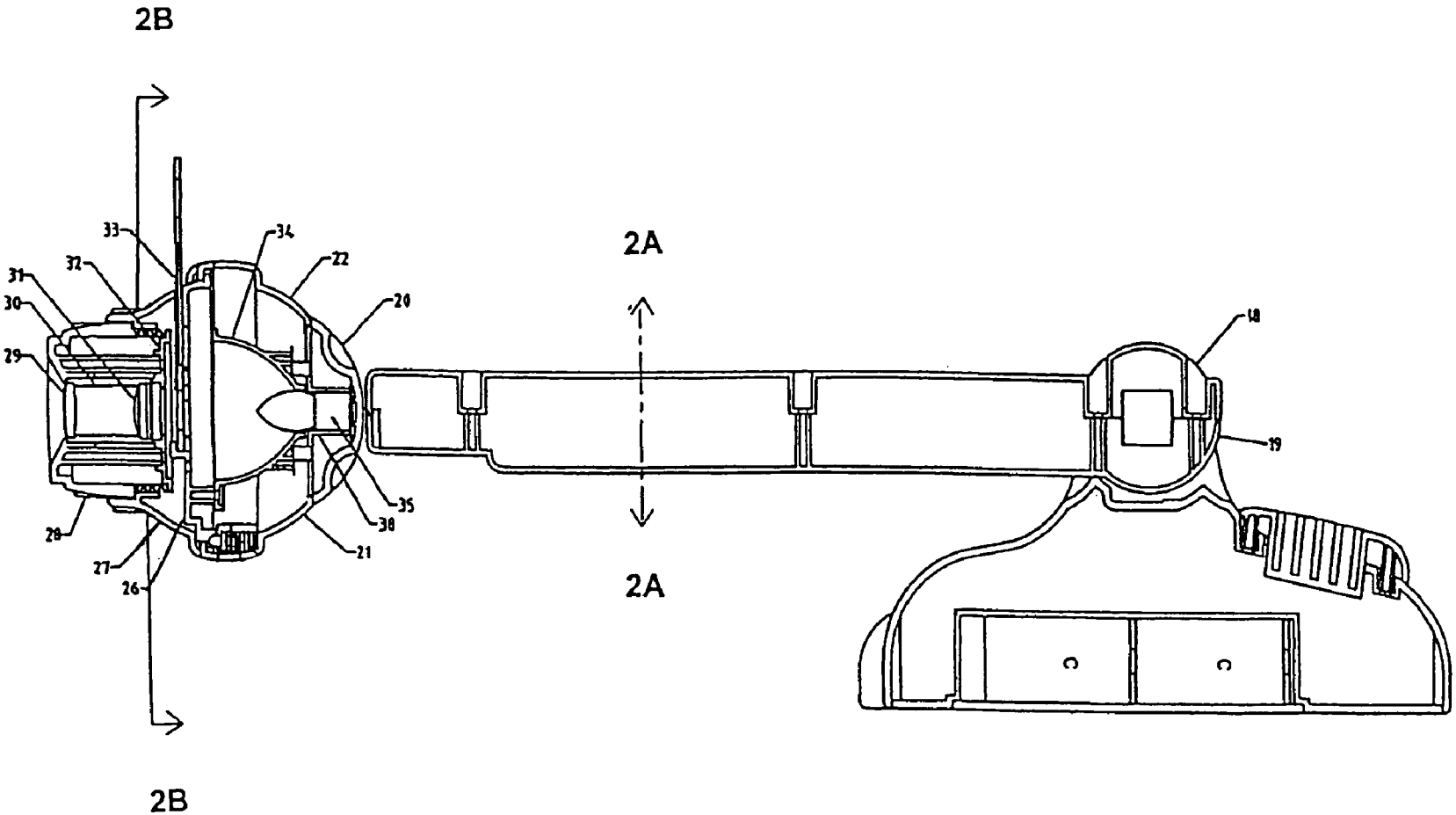
FIG. 2 is an enlarged sectional view of the projector desk lamp of the invention of FIG. 1 in a vertical plane.
Figure 2A:
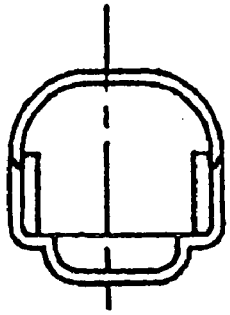
FIG. 2A is an enlarged cross-sectional view of a stem portion of the lamp of FIG. 2 taken along the line 2A—2A thereof.
Figure 2B:
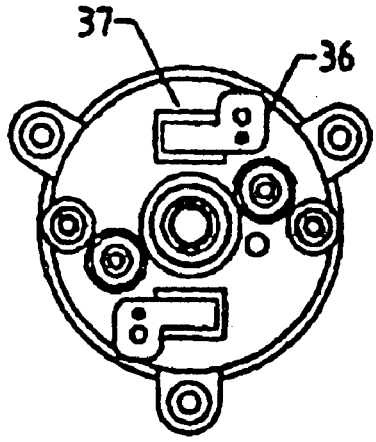
FIG. 2B is an enlarged cross-sectional view of a head portion of the lamp of FIG. 2 taken along the line 2B—2B thereof.

FIG. 2 is a sectional view of the whole projector desk lamp of this invention in vertical plan. In FIG. 2, the head 22 of the projector desk lamp of FIG. 1 is enlarged to show details. The front part of the head 22 is an adjustable lens assembly comprising a pair of focus lenses 29 and 31, a focus lens holder 30, and a focus ring 28. A holder 32 keeps all the parts in position. The lens assembly 28–32 can be screwed in or screwed out of the film holder 27 by matching screw threads. The film holder 27 further mounts a slot plate 26 for receiving slide 33. The middle part of the head is a lamp body which is formed by two parts: the top part 22 and the bottom part 21. Inside the lamp body 21, 22 is a reflector 34. The hind-most part of the head 22 is the lamp cover 20. Inside the lamp cover 20 there are a bulb 35, a lamp holder 38 and two contact plates 36, 37 (FIG. 2B). In FIG. 2, the cross section of stem 18, 19 is presented for showing the construction. The stem is also formed by two parts, the top part 18 and the bottom part 19.

Figure 3:
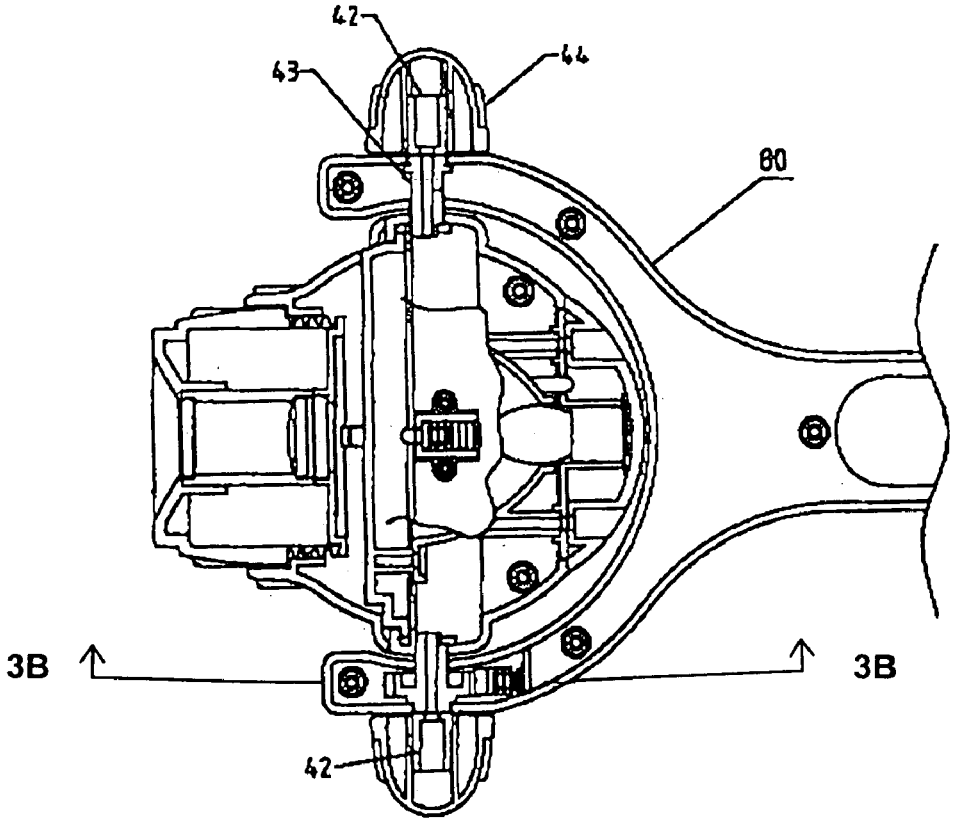
FIG. 3 is an enlarged horizontal section of the head of the projector desk lamp of FIG. 1.
Figure 3A:
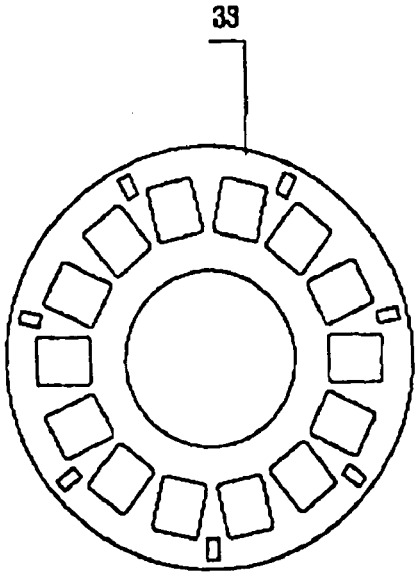
FIG. 3A is an enlarged plan view of a slide for the head of FIG. 3.

FIG. 3 is an enlarged horizontal section of the head of the projector desk lamp of FIG. 1. In FIG. 3, a bracket 60 is formed on one end of the stem 18, 19. Therefore, the head 22 can be swung in the bracket 60 of the stem 18, 19 and can be locked in any position by a lock-knob 44. FIG. 3A shows a disc shaped slide 33 with 14 rectangular transparent films. Of course, slide 33 with any shape other than disc can also be used in this invention.

Both FIG. 2 and FIG. 3 show that the head 22 mainly comprises a bulb 35, a reflector 34, an adjustable lens assembly 28-32 (comprising a set of convex lens and concave lens and a focus ring 28), and a disc-shaped slide 33. Therefore, if this projector desk lamp is used as a projector, since the head 22 can be placed over the desk surface (or toward the wall) with any intended distance, the enlarging ratio roughly equals the distance from the lens to the desk surface (or to the wall) divided by the distance from the slide to the lens. Once the distance from the lens to the desk surface/wall is fixed, the user can adjust the focus ring to get a sharp image. Light from the bulb 35 is firstly converged by the reflector 34, then passes through the film of the slide 33 and is then focused by the adjustable lens assembly 28-32 and projected on the surface on which the image of the film is intended to be projected. The user then can easily trace the projected image on such surface by free hand or by drawing instruments such as a ruler, a template, etc.

When the projector desk lamp of this invention is used as a desk lamp, the slide 33 can be removed and the illuminated area becomes larger. The focus ring 28 can be adjusted to adjust the size of the illuminated area. It is obvious that the slide 33 can also be used to change the color of the shining light or act as a barrier to limit the size of the illuminated area.

Figure 3B:
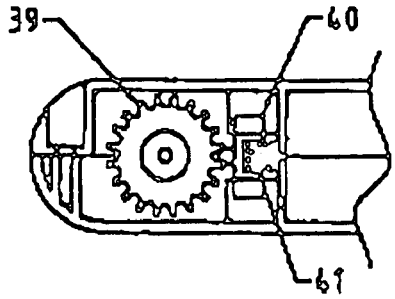
FIG. 3B is an enlarged fragmentary sectional side view of the head of FIG. 3.

FIGS. 3 and 3B also show the construction of the locking system that comprises a lock-knob 44, a lock-knob adaptor 42 and a lock-knob hinge 43. One of the hinges has a coaxial gear 39 which is coupled by a pin 40 biased by a spring 41. Therefore, when the head 22 is forced to rotate, the pin 40 will be pushed back by the teeth. Once the rotation stops, the pin 40 is biased by the spring 39 to the recesses between two neighboring teeth. Thus, the head 22 will be stopped in the position.

Figure 4:
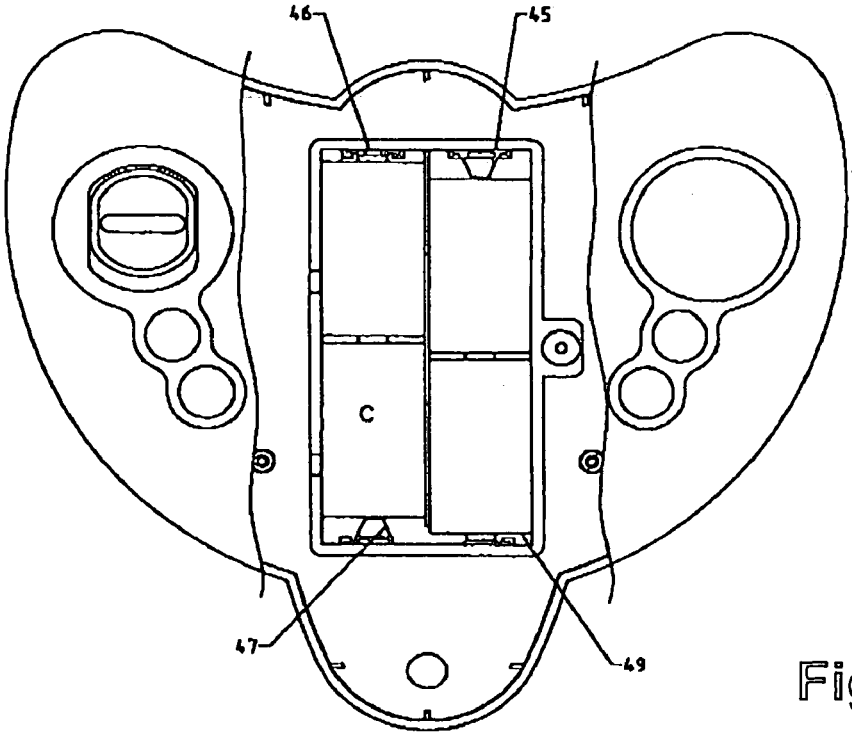
FIG. 4 is a top view, partly broken away and partly in section, of the base of the projector desk lamp of FIG. 1.
Figure 4A:
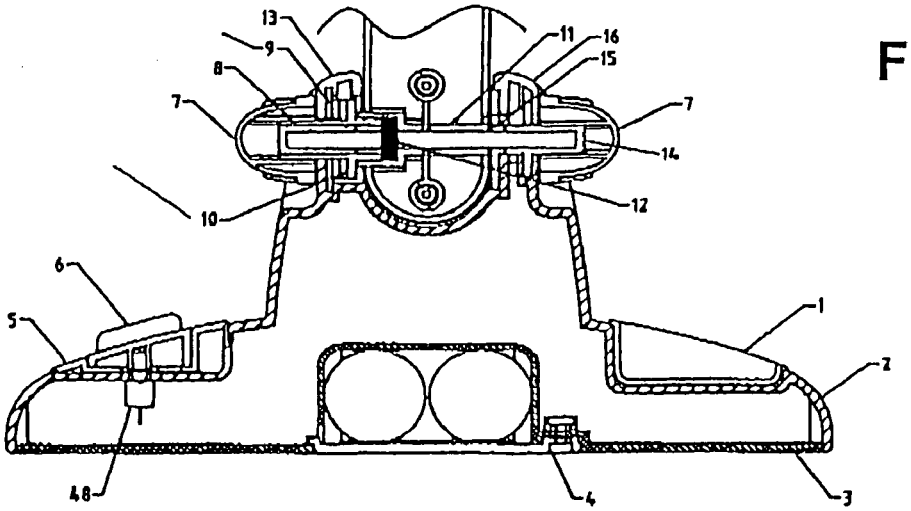
FIG. 4A is a front sectional view of the base of FIG. 4.
Figure 4B:
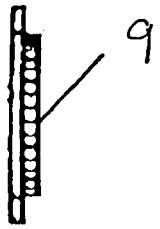
FIGS. 4B, 4C and 4D are enlarged front, side and top plan views of a component of FIG. 4A.
Figure 4C:
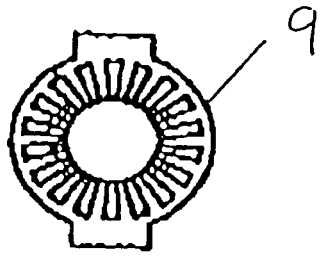
Figure 4D:
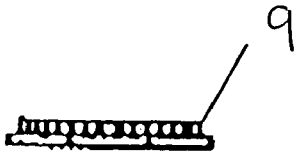
Figure 4E:
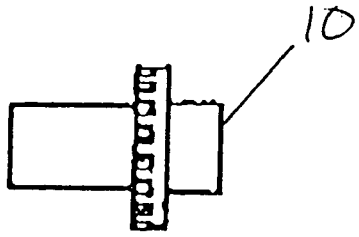
FIGS. 4E and 4F are enlarged front and side views of another component of FIG. 4A.
Figure 4F:
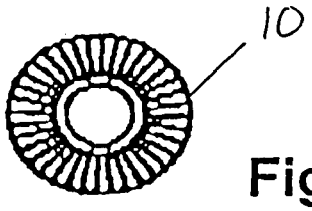

FIGS. 4 and 4A show the sectional top and front views of the base of the projector desk lamp in FIG. 1. FIG. 4 is a top view of the base 2 partially sectioned to show the batteries 45, 46, 47, 49 installed in the base 2. FIG. 4A is a sectional view of the base 2 showing the batteries 45, 46, 47, 49, the switch 48, the select knob 6, the select knob holder 5 and the mechanical construction of the lock knob mechanism which form the adjustable articulate joint between the stem 18, 19 and the base 2. As per the construction shown in FIG. 4A, a pin 8 and a pin 14 connect to two angle-adjust knobs 7. Two angle-adjust gears 9 and 10 are installed on the pin 8. Spring 12 always biases the two pins 8 and 14 (and two knobs 7) away from each other. The hinge plate 15 is connected to the hinge 11. There are two covers 13 and 16 for covering the adjustable articulate joint on both ends. In FIGS. 4A–4E, two angle-adjust gears 9 and 10 abut each other and are in a full meshing by the thrust of the spring 12. In this position, the stem 18, 19 and the base 2 are no longer locked. That is, the angle between the stem 18, 19 and the base 2 can be adjusted. Since the projector desk lamp of this invention will be adjusted more frequently than common desk lamps, this inventive lock knob mechanism is advantageous.

Furthermore, FIG. 4A shows a holder 1 for receiving tiny parts such as erasers or clips. Though in this embodiment the battery is used for energizing the bulb, it is also possible to use other electrical power sources to light up the bulb, such as AC (alternative current) or DC (direct current) supply. In this embodiment, a low-voltage bulb, (say bulb with 3.5 V or 3.75 V rating) is used for avoiding electric shock. 4×1.5 V C-size batteries are used to provide the best illumination of a low-voltage (3.6V) bulb. In so doing, the average life of the batteries will typically be approximately 14–15 hours. If safety extra low voltage (SELV) power supply is used, there should not be any battery-life problem. Besides, rechargeable batteries with electronic charging circuitry can also be used for extending the usability. Therefore, this lamp can either be used in a place without any power supply (in this case, battery is used for supplying power) or in a place with different voltages of power supply (say 120 V AC to 230 V AC). A power supply with different voltages can be easily transferred into low constant DC current by electronic circuitry for both lighting up the bulb and charging the batteries.

FIG. 4A shows that the base 2 has a bottom cabinet 3 for receiving the battery. The bottom cabinet has a cover 4 for battery installation.

While an exemplary embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A projector desk lamp comprising:

a base for supporting the desk lamp;

a stem with one end connected to form an adjustable joint with said base so that the stem can be freely swung between a horizontal position and an articulable vertical position and can be locked in a plurality of positions in between;

a lock knob mechanism used for quickly releasing and locking said stem with said base, said stem and base connected by a hinge, said lock knob mechanism comprising a spring biasing a pair of gears into engagement for locking the position of said stem with said base about said hinge and biasing apart a pair of pins and corresponding knobs, said knobs being depressable to release the position of said stem with said base;

a bracket formed on the other end of said stem;

a lamp head which is connected to form an articulable joint adjustable by said bracket so that said head can be swung more than 180 degrees and can be locked in a plurality of positions in between; and said lamp head comprising a bulb, a reflector, an adjustable lens assembly comprised of at least a set of convex lens and concave lens and a focus ring and a slide.

2. A projector desk lamp of claim 1 wherein the base, the stem and the head are all made of plastic materials.

3. A projector desk lamp of claim 1 wherein the slide is removable when the lamp is used as a desk lamp.

4. A projector desk lamp of claim 1 wherein the slide functions as a color filter.

5. A projector desk lamp of claim 1 wherein the slide functions as a light barrier.

6. A projector desk lamp of claim 1 wherein images from the slide can be projected on a flat surface when the lamp is used as a projector.

7. A projector desk lamp of claim 1 wherein the bulb is energized by batteries inside the base.

8. A projector desk lamp of claim 1 wherein the bulb is energized by a remote electrical power supply.

9. A projector desk lamp of claim 1 wherein an electronic circuitry is equipped for both energizing the bulb and recharging a rechargeable battery.

10. A projector desk lamp of claim 1 wherein the ratio of enlargement of an image is achieved by adjusting the distance between a surface on which such image is projected and the lens.

11. A projector desk lamp of claim 1 wherein the slide is disc-shaped.

12. A projector desk lamp comprising:

a base for supporting the desk lamp;

a stem with one end connected to form an adjustable joint with said base so that the stem can be freely swung between a horizontal position and an articulable vertical position and can be locked in a plurality of positions in between;

a lock knob mechanism used for quickly releasing and locking said stem with said base;

a bracket formed on the other end of said stem;

a lamp head which is connected to form an articulable lamp head joint adjustable by said bracket so that said head can be swung more than 180 degrees and can be locked in a plurality of positions in between; and said lamp head comprising a bulb, a reflector, an adjustable lens assembly comprised of at least a set of convex lens and concave lens and a focus ring and a slide, wherein said lamp head joint employs a hinge having a coaxial gear with teeth which is coupled by a spring biased pin wherein the head is rotatable and the pin is engageable between teeth to rotatably stop the head at a rotation position.

13. A projector desk lamp of claim 12 wherein the base, the stem and the head are all made of plastic materials.

14. A projector desk lamp of claim 12 wherein the slide is removable when the lamp is used as a desk lamp.

15. A projector desk lamp of claim 12 wherein the slide functions as a color filter.

16. A projector desk lamp of claim 12 wherein the slide functions as a light barrier.

17. A projector desk lamp of claim 12 wherein images from the slide can be projected on a flat surface when the lamp is used as a projector.

18. A projector desk lamp of claim 12 wherein the bulb is energized by batteries inside the base.

19. A projector desk lamp of claim 12 wherein the bulb is energized by a remote electrical power supply.

20. A projector desk lamp of claim 12 wherein an electronic circuitry is equipped for both energizing the bulb and recharging a rechargeable battery.

* * * * *